US005806144A

United States Patent [19]

Fries

[11] Patent Number: 5,806,144

[45] Date of Patent: Sep. 15, 1998

[54] DEVICE FOR A DOOR HINGE STRUCTURE

[75] Inventor: Bror Fries, Hishult, Sweden

[73] Assignee: Grorud Industrier AS, Oslo, Norway

[21] Appl. No.: 805,674

[22] Filed: Feb. 27, 1997

[30] Foreign Application Priority Data

Nov. 21, 1996 [NO] Norway ..... 964956

[51] Int. Cl.[6] ..... E05D 7/04

[52] U.S. Cl. ..... 16/246; 16/254; 16/271; 49/381

[58] Field of Search ..... 16/246, 245, 237, 16/238, 254, 257, 258, 268, 271, 272, 301, 382, 387, 389, 392; 49/381, 398, 399, 400

[56] References Cited

U.S. PATENT DOCUMENTS

| | | | |
|---|---|---|---|
| 2,131,802 | 10/1938 | Harmon | 16/258 |
| 3,423,786 | 1/1969 | Arias et al. | 16/257 |
| 3,938,219 | 2/1976 | Rock et al. | 16/238 |
| 4,706,332 | 11/1987 | Lautenschlager, Jr. | 16/246 |
| 4,825,507 | 5/1989 | Killingstad | 16/246 |
| 4,839,940 | 6/1989 | Grass | 16/258 |
| 5,193,308 | 3/1993 | Davidian | 16/257 |
| 5,339,493 | 8/1994 | MacIntyre | 16/237 |

FOREIGN PATENT DOCUMENTS

| | | | |
|---|---|---|---|
| 310246 | 1/1919 | Germany | 16/258 |
| 2032994 | 5/1980 | United Kingdom | 16/237 |
| 90/10775 | 9/1990 | WIPO | 16/257 |

*Primary Examiner*—Chuck Mah
*Attorney, Agent, or Firm*—Barry R. Lipsitz; Ralph F. Hoppin

[57] ABSTRACT

A device for a door hinge structure of the snap-in type, where the hinge has a first hinge flap designed to be secured to a door frame and pivotally attached to a second hinge flap in the form of an insertion part which can be snapped into an insertion pocket in a receiving part that is secured to an end portion of a door leaf. The receiving part has a spring-loaded peg which is slidably mounted in a slide that is moveable parallel to the depth direction of the insertion pocket. The slide forms steplessly adjustable threaded engagement with an axially immoveable, rotatable adjusting screw, provided in the receiving part, and the peg is moveable transverse to the insertion pocket for releasable engagement with a hole or a cut-out portion in the insertion part, whereby the length of insertion of the insertion part in the depth direction of the insertion pocket is steplessly adjustable. It is also possible to make the hinge height adjustable in that the insertion pocket, seen in the altitudinal direction of the hinge, has a height that is greater than the height of the insertion part , and that the receiving part is equipped with two inclined height adjusting screws which are adjustable, and with conical tip portion form contact with respectively an upper and a lower edge of the insertion part.

32 Claims, 7 Drawing Sheets

DEVICE FOR A DOOR HINGE STRUCTURE

BACKGROUND OF THE INVENTION

The present invention relates to a device for a door hinge structure of the snap-in type, where the hinge has a first hinge flap designed for securing to a door frame and pivotally attached to a second hinge flap in the form of an insertion part which can be snapped into an insertion pocket in a receiving part which is secured in an end portion of a door leaf.

The most common hinge structures for doors are the type where one of the hinge members can be lifted off or put on the other hinge member. The drawback of such hinges is that the lower half is always supporting and the upper half is always hanging, which means that such hinges may easily develop an unbalanced load. Fixed hinges, however, will have an evenly distributed load. They can therefore be manufactured having the same strength as a larger hinge of the aforementioned type, but having considerably smaller dimensions. However, in the case of heavy doors the fixed hinge has the disadvantage that it must be screwed in place, i.e., it is not possible to hook the door on. It is true that hinges of the snap-in type have been on the market for the last 20 years, but owing to their structure they have only been suitable for light doors, so-called inside doors, and have not been adjustable in any way other than by turning the hinge in a lateral direction. However, such bending of a hinge will reduce the strength of the material. It is the objective of the present invention, therefore, to combine the simplicity and speed of the lift-off hinge, as regards hanging a door securely in a frame, with the strength of the fixed hinge in consequence of the snap-in function. A further objective of the invention is to provide a new hinge structure which at the same time may optionally be made adjustable in an altitudinal direction and a lateral direction. It is an objective that the present invention will be equally useable on both non-rabbeted and rabbeted doors.

SUMMARY OF THE INVENTION

According to the invention, the aforementioned device is characterised in that the receiving part has a spring-loaded peg which is slidably supported in a slide that is moveable parallel to the depth direction of the insertion pocket, that the slide forms a steplessly adjustable threaded engagement with an axially immoveable, rotatable adjusting screw located in the receiving part, and that the peg is moveable transverse to the insertion pocket for releasable engagement with a hole or a cut-out portion in the insertion part, whereby the length of insertion in the depth direction of the insertion pocket is steplessly adjustable.

Additional embodiments of the device according to the invention will be made clear in the attached patent claims, and the description below with reference to the attached drawing.

DETAILED DESCRIPTION OF THE INVENTION

Figure 1:
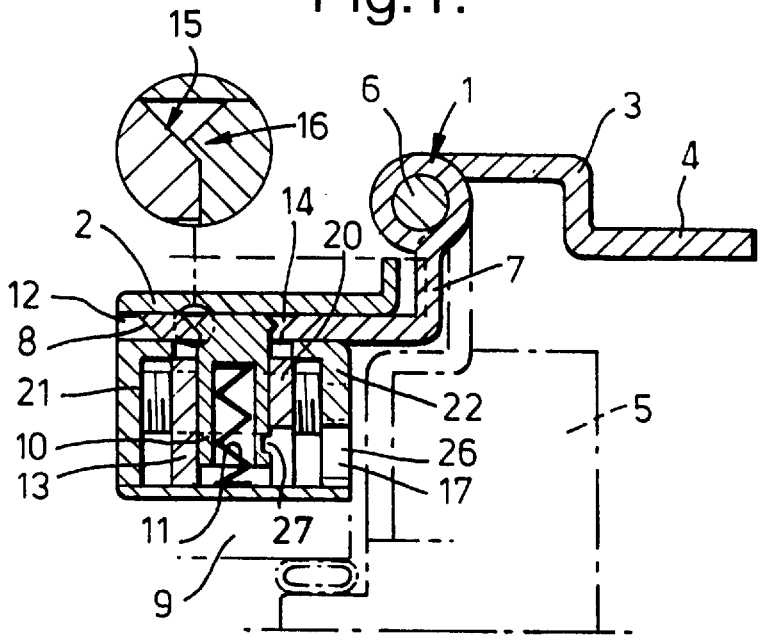
FIG. 1 shows a horizontal cross-section through a first embodiment of the device according to the invention, designed for a rabbeted door.
Figure 4:
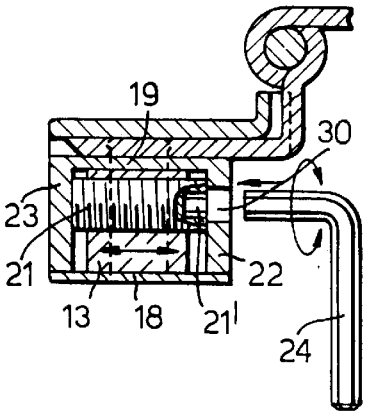
FIG. 4 shows the hinge of FIG. 1 in horizontal cross-section in order to illustrate the lateral adjustment potential.
Figure 5:
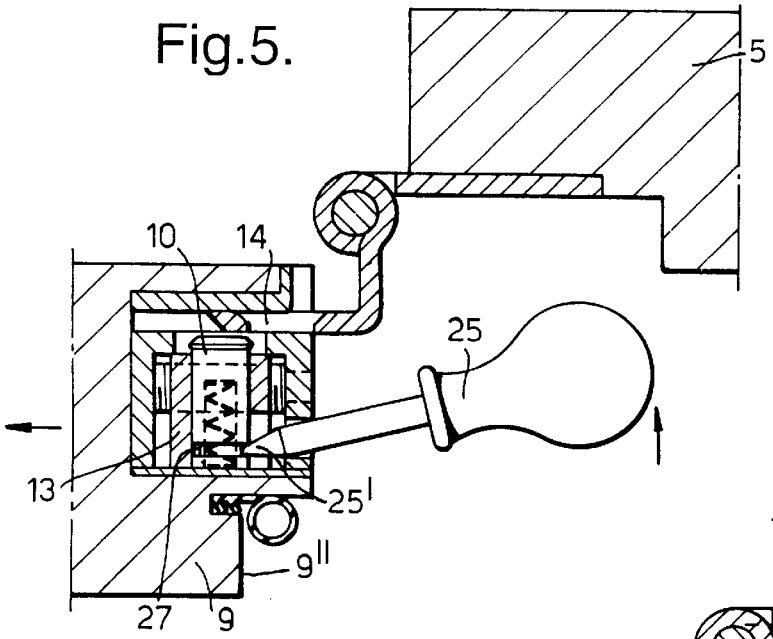
FIG. 5 shows in horizontal section a fourth variant of the device according to the invention in connection with a non-rabbeted door, where the insertion part is disengaged from the receiving part.

The hinge according to the present invention consists of two main parts: an articulated, fixed part 1 and a receiving part 2. The articulated part has a first hinge flap 3 which, via hole 4, is designed to be screwed into a door frame 5. The first hinge flap 3 is, via a hinge pivot 6, pivotally connected to a second hinge flap 7 on the fixed part 1, said second hinge flap 7 constituting an insertion part or insertion tongue, which at its outer end has a chamfering 8. When the door leaf 9, to which the receiving part 2 is secured in an end part thereof, is introduced into the insertion part 7, the chamfering 8 will depress a spring-loaded peg 10 in the receiving part 2. With the aid of a spring 11, the peg 10 is pressed outward from its slidable support in a slide 13 that is moveable in a depth direction of the insertion pocket 12 parallel to the receiving part 2. When the door 9 is pressed further in towards the door frame 5, clearance for the insertion part 7 is obtained. The insertion part 7 has a hole 14 which the peg 10 moves towards and snaps into with the aid of the spring 11 once the insertion part 7 is in position, as shown in FIG. 1. Here, the peg 10 locks the insertion part 7 in place so that the receiving part 2 and door frame mountable hinge part 1 thereby form a complete hinge unit. In order to eliminate the risk of the peg 10 possibly working its way out of the hole 14 when the door structure is, for example, subjected to varying loads, which will generate a risk of the door 9 becoming detached from the hinge, a counterboring or chamfering 15 is made in the hole 14. At the same time a grip flange 16 is also made on the peg 10. The peg 10 and the hole 14 can be designed to be rectangular, although another cross-sectional shape, e.g., round, oval, hexagonal. etc., is equally conceivable. The hole 14 can be made with a clearance to allow height adjustments, as will be described below in connection with FIGS. 7 and 8. The peg 10 is axially moveable in the slide 13. The slide 13 is located in the cavity 17 of the receiving part. The slide 13 forms slidable engagement with the walls of the cavity, as indicated be means of the reference numerals 18 and 19 on FIG. 4. In the direction of motion (the lateral direction of the hinge or the depth direction of the insertion pocket 12), the slide 13 is, of course, shorter than the cavity 17, so that the slide 13 can be moved corresponding to at least the range of adjustment that is desired between the door frame 5 and the door leaf 9. For adjustment, the slide 13 is constructed with at least one transverse, through-going threaded hole 20 for an adjusting screw 21. The adjusting screw 21 is axially non-moveable, the end portions forming moveable contact against the front and back walls 22, 23 of the insertion part. When the adjusting screw 21 is turned with the aid of a tool 24, as shown in FIG. 4, the slide 13 will move in one direction or the other, depending upon the direction of rotation of the screw 21. Thus, the peg 10 will also move together with the slide 13, whereby also the insertion part 7 will move if there is engagement between the peg 10 and the hole 14 in the insertion part 7. When the insertion part 7 moves in a lateral direction, i.e., in the depth direction of the insertion pocket 12, the door leaf 9 will move in a lateral direction relative to the door frame 5. This structure thus results in the door leaf not being able to move in any way other than when actuated by the tool 24.

Figure 6:
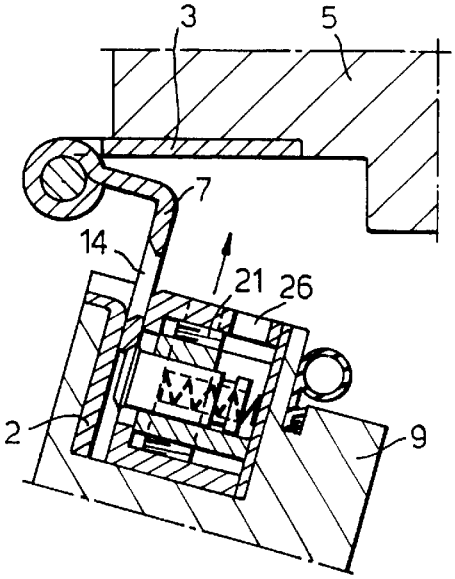
FIG. 6 shows the device of FIG. 5 in horizontal section, where, during the hooking on of a door leaf, the insertion part enters into the receiving part.

When the door leaf is to be dismounted from the hinge, i.e., that the receiving part 2 is to be released from the insertion part 7, a tool, e.g., a screw driver 25, is introduced into a release hole 26. The tip 25' of the screw driver 25 is inserted into a flange portion 27 on the peg 10. By means of the lever principle in the hole 26, the peg 10 is pressed downward to its bottom position in the slide 13, whereby the peg 10 disengages from the hole 14 in the insertion part 7, and the door leaf 9 with receiving part 2 mounted in place can thereby be pulled off the insertion part 7. This indicated in more detail in FIG. 6.

Figure 7:
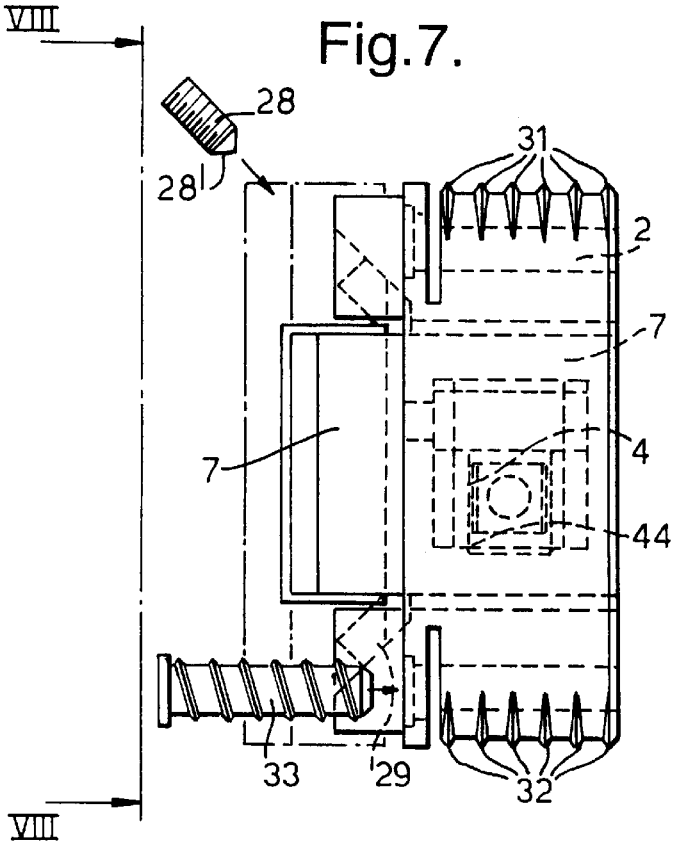
FIG. 7 is a vertical view of a hinge for a rabbeted door with height adjusting screws and expansion pegs for fixing the receiving part in a door leaf.
Figure 8:
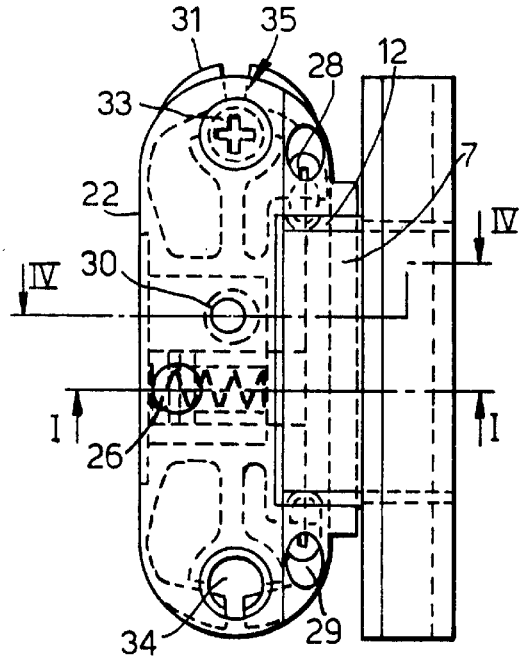
FIG. 8 shows the section VIII—VIII in FIG. 7.
Figure 9:
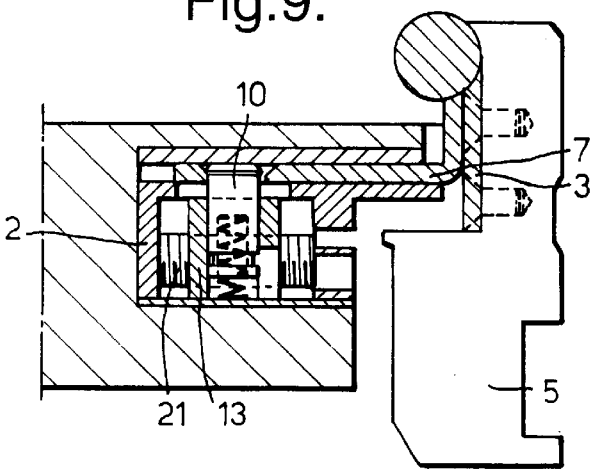
FIGS. 9, 10 and 11 show a fifth embodiment of the device according to the invention in different laterally adjusted positions.
Figure 10:
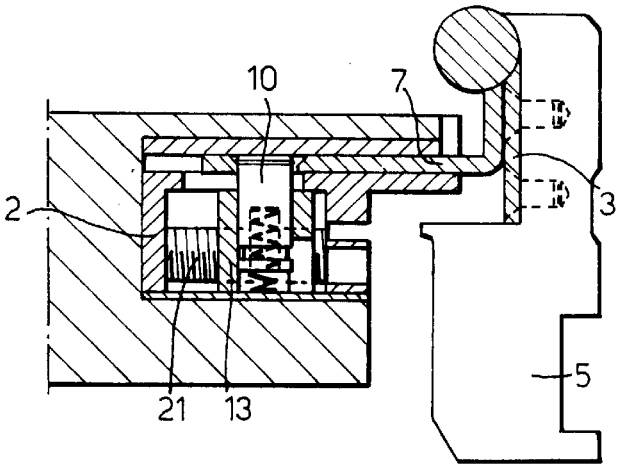
Figure 11:
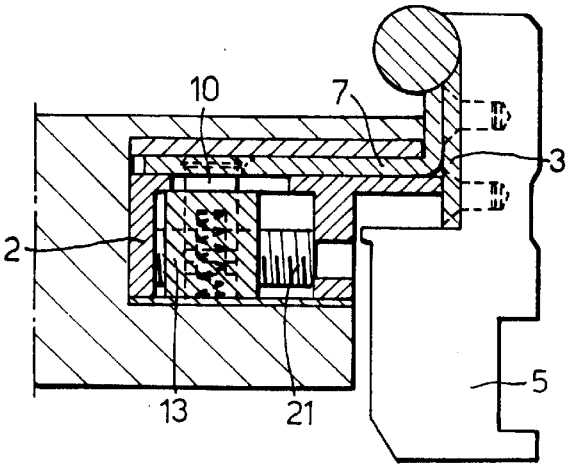

The device according to the invention also allows a height adjustment, as will more easily be understood with reference to FIGS. 7 and 8. Inclined screws 28, 29 are used. The insertion part 7, seen in the altitudinal direction of the hinge, is given a height dimension which is somewhat smaller than the height dimension of the insertion pocket 12,. thereby enabling the insertion part 7 to move in the altitudinal direction of the hinge inside the insertion pocket 12. This height adjustability is provided by means of the screws 28 and 29, as tightening one of the screws 28, 29 and releasing the other screw 28, 29 correspondingly will allow an upward or downward adjustment of the insertion part 7 relative to the insertion pocket 12. The screw 28 is preferably designed to have a chamfering 28' at the outer end of thereof, said chamfering 28' coming into direct contact with a horizontally positioned edge of the insertion part 7.

On the end wall 22 of the receiving part 2, there is a hole 30 for the introduction of the tool 24 inside an engagement hole 21' on the adjusting screw 21.

The hole 26 is also found in said end wall 22.

The receiving part 2 can be fixed in the door leaf in that a recess is made in the end portion of the door leaf. The receiving part can either be secured with the aid of ordinary screws which engage with the framework of the door leaf 9, or be secured by means of an expansion principle that is known per se. Grip flanges 31, 32 are provided at the upper and lower end portions of the receiving part, as shown in FIG. 7. When the receiving part 2 is placed in its recess in the end portion of the door leaf 9, an expansion pin 33 is introduced into a receiving opening 34 in the receiving part 2, whereby the internal portions 35 of the fixing flange 31; 32 press the fixing flanges 31, 32 outward, thereby pressing said flanges 31,32 into the framework of the door leaf 9 in the end portion thereof. The threads on the pin 33 are only present to facilitate a possible dismounting of the receiving part 2 from a door leaf.

Figure 2:
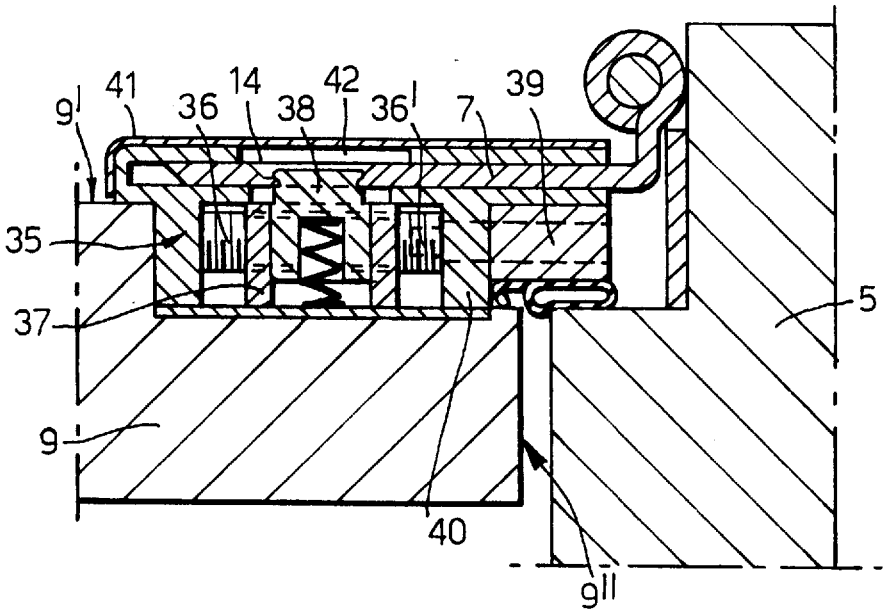
FIG. 2 shows a second embodiment according to the invention, designed for surface mounting at the end portion of a door leaf.
Figure 3:
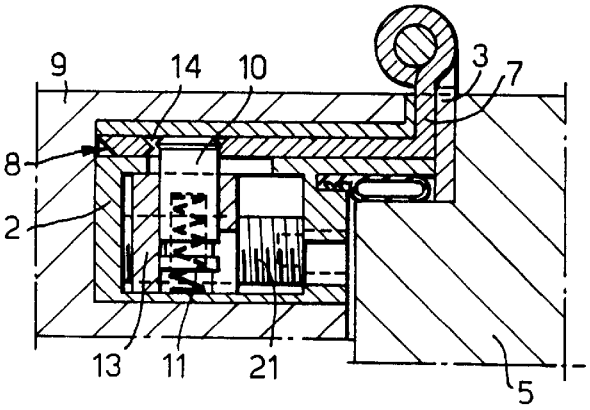
FIG. 3 shows a third embodiment of the device according to the invention.

FIG. 2 shows how the receiving part, in contrast to the embodiments which are illustrated in the other FIGS. 1 and 3–13, is inlaid at an end portion of the door leaf from the flat side thereof instead of from the end edge 9" of the door leaf 9. In this case, the insertion part 7 will be positioned at a distance from and parallel to the flat portion 9' of the door leaf. The receiving part, here indicated by means of the reference numeral 35, will have the same function as regards lateral adjustment with the aid of an adjusting screw 36, which interacts with a slide 37, and where a spring-loaded peg 38 is able to engage with the hole 14 in the insertion part 7. Hole 39 for the introduction of a tool 24 to engage with a hole 36' on the adjusting screw 36 is provided in respectively the end portion 9" of the door leaf 9 and in an end wall 40 of the receiving part 35. To detach the door leaf from the insertion part 7, there is provided, as an alternative to the previously described solution, a removeable cover 41 so that the peg 38 can be pushed downward via a hole 42 in the receiving part 35 when the cover 41 has been removed.

As can be seen clearly from, e.g., FIGS. 1, 2, 3 and 5, and also 9 to 13, the top of the peg which is to engage with the hole 14 in the insertion part 7 is designed to have a roughly dovetail-shaped cross-section.

Figure 12:
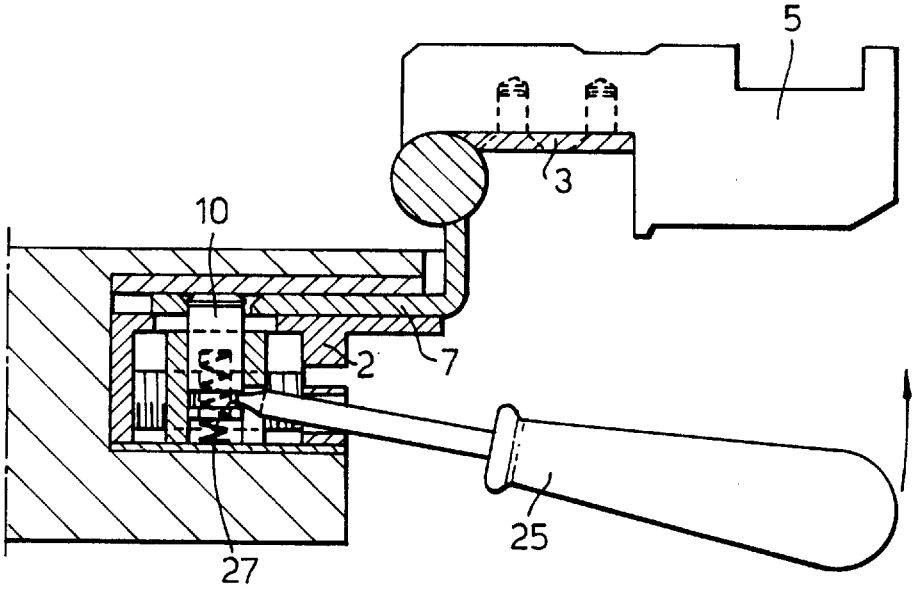
FIGS. 12 and 13 show typical release of the insertion part from the receiving part for a hinge of the type illustrated in FIGS. 9–11.
Figure 13:
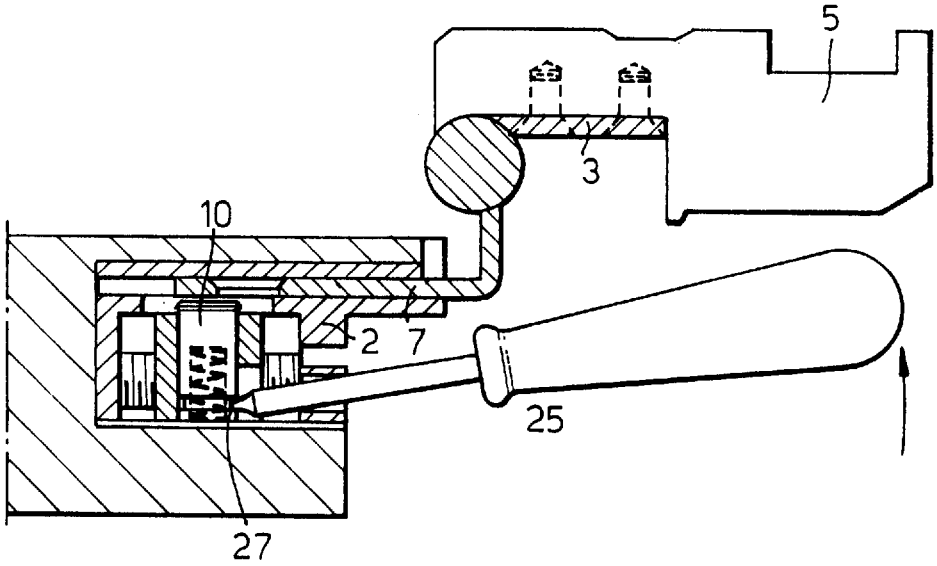

FIGS. 9–13 are included to illustrate the adjustability of the slide 13 with the aid of the adjusting screw 21, so that the position of the insertion part 7 relative to the receiving part is adjustable, thereby allowing lateral adjustment of the door leaf 9 relative to the door frame 5. FIGS. 12 and 13 show how the peg 10 can be disengaged from the hole 14 of the insertion part 7 with the aid of a tool 25, e.g., a screw driver 25. In other respects, the release principle is as illustrated and described in connection with FIGS. 5 and 6.

Figure 14:
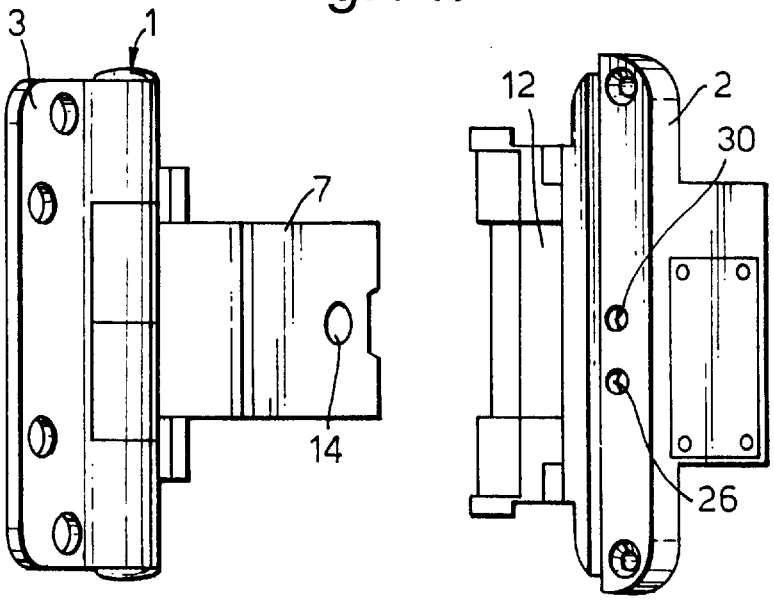
FIG. 14 shows in perspective the joining of a hinge as illustrated in FIGS. 9–11.
Figure 15:
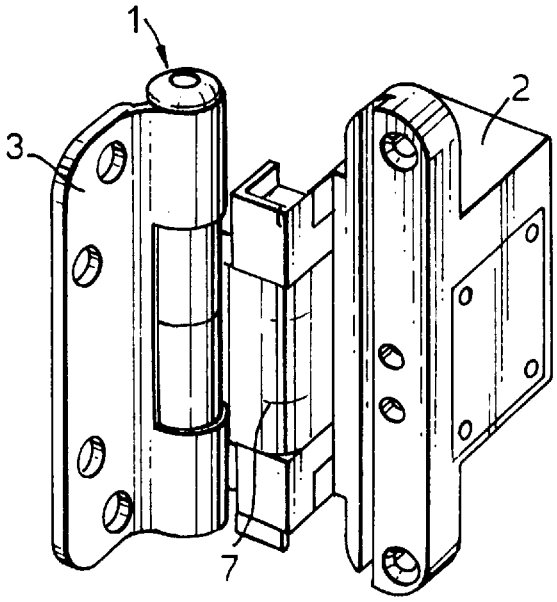
FIGS. 15 and 16 show the hinge according to FIGS. 9–11 once joined, in respectively a frontal and a rear view of the insertion part.
Figure 16:
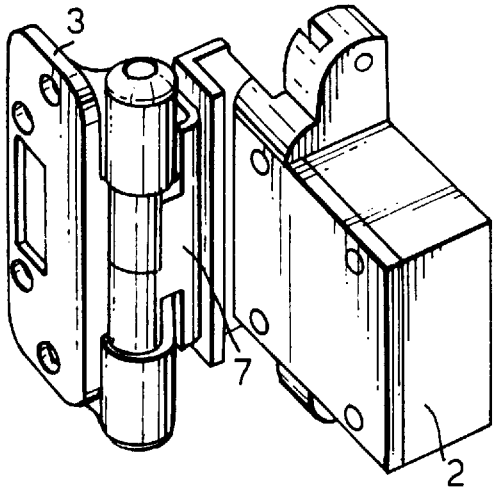

FIGS. 14–16 show in perspective the joining of the fixed part 1, which is to be secured to the door frame via the hinge flap 3, to the receiving part 2 by means of the engagement between the insertion part 7 and the insertion pocket 12 on the receiving part 2.

The solution which is shown for the hinge according to FIGS. 9-16 is not designed for height adjustment. However, it will be possible, with minor modifications, to be able to provide a height adjustment potential of this kind, namely by allowing the insertion part 7 to be smaller in height, seen in the altitudinal direction of the hinge, than the height of the insertion pocket 12 in the insertion part 2.

In the cases where height adjustability is an additional requirement, it will be necessary to ensure that also the spring-loaded peg 10; 38 is moveable in the altitudinal direction. To be able to make this possible, the peg 10; 38 is provided with at least one flat portion 42 which extends in the altitudinal direction of the hinge, and a peg accommodating hole 44 in the slide 13; 37 has a corresponding flat portion, but having a larger extent in the altitudinal direction of the hinge than the flat portion of the peg. In this way, the peg is also prevented from rotating and possibly becoming jammed on movement of the peg in the peg accommodating hole in the slide.

Having described my invention, I claim:

1. A snap-in door hinge device, comprising:

(a) a first section having a first hinge flap for attachment to a door frame, and a second hinge flap which is pivotally attached by means of a hinge pivot pin to said first hinge flap;

(b) a second section which is attachable to an end portion of a door leaf;

said second section comprising:

(i) an insertion pocket for receiving in snap engagement said second hinge flap in an insertion direction of said second section;

(ii) an axially immovable rotatable adjustment screw;

(iii) a slide that is in adjustable engagement with said adjustment screw; and (iv) a spring-loaded peg slidably mounted in said slide so as to be moveable substantially transversely to said insertion direction for releasable engagement with a hole in said second hinge flap;

wherein said slide and said spring-loaded peg are adapted to move together substantially parallel to said insertion direction when said adjustment screw is rotated, thereby allowing adjustment of an insertion depth of said second hinge flap into said insertion pocket.

2. The device of claim 1, wherein:

said insertion direction is substantially parallel to a surface of the door leaf.

3. The device of claim 1, wherein:

an opening is provided in said second section to allow access by a tool to move said spring-loaded peg relative to said slide for bringing said spring-loaded peg out of engagement with said second hinge flap.

4. The device of claim 3, wherein:

said spring-loaded peg comprises a flange portion for engagement with a part of said tool.

5. The device of claim 1, wherein:

an opening is provided in said second section for enabling rotation of said adjustment screw by a tool.

6. The device of claim 1, wherein:

a forward edge of said second hinge flap is chamfered on a side thereof which faces said slide; and said hole is chamfered on a side thereof facing away from said slide.

7. The device of claim 6, wherein:

said chamfered side of said forward edge is adapted to depress said spring-loaded peg from an initial position when said second hinge flap is inserted into said insertion pocket;

said spring-loaded peg being restored to said initial position for engaging said second hinge flap when said hole is moved into alignment with said spring-loaded peg.

8. The device of claim 7, wherein:

said chamfered side of said hole is adapted to engage said spring-loaded peg when said spring-loaded peg is restored to said initial position.

9. The device of claim 6, wherein:

a top portion of said spring-loaded peg which is adapted to engage said second hinge flap at said hole is approximately dovetail-shaped in cross-section.

10. The device of claim 1, wherein:

a top portion of said spring-loaded peg which is adapted to engage said second hinge flap at said hole is approximately dovetail-shaped in cross-section.

11. The device of claim 1, wherein:

said spring-loaded peg has a non-circular cross-section.

12. The device of claim 1, wherein a height of said insertion pocket is greater than a height of said second hinge flap in a direction which is substantially parallel to a longitudinal axis of said hinge pivot pin, said second hinge flap extending in said direction between first and second edges thereof, further comprising:

adjustment means for adjusting a relative position of said second section relative to said second hinge flap in said direction.

13. The device of claim 12, wherein:

said adjustment means comprises two adjustment screws operatively associated with said second section;

said two adjustment screws having respective conical tip portions which are adapted to adjustably bear against said first and second edges of said second hinge flap.

14. The device of claim 1, wherein:

said hole in said second hinge flap has a greater dimension in said insertion direction than in a direction which is substantially parallel to a longitudinal axis of said hinge pivot pin.

15. The device of claim 1, wherein:

said spring-loaded peg has at least one flat portion extending parallel to a direction which is substantially parallel to a longitudinal axis of said hinge pivot pin;

said slide comprises a receiving hole for receiving said spring-loaded peg;

said receiving hole has a flat portion corresponding to said flat portion of said spring-loaded peg; and said flat portion of said receiving hole has a greater dimension in said direction than a dimension of said flat portion of said spring-loaded peg to allow said spring-loaded peg to be adjustably positioned relative to said receiving hole in said direction.

16. The device of claim 15, wherein:

said flat portion of said spring-loaded peg and said flat portion of said receiving hole prevent rotation of said spring-loaded peg with respect to said receiving hole.

17. A snap-in door hinge device which is attachable to an end portion of a door leaf, and which is adapted to receive a second hinge flap that is pivotally attached by means of a hinge pivot pin to a first hinge flap, said first hinge flap being adapted to be attached to a door frame, comprising:

an insertion pocket for receiving in snap engagement said second hinge flap in an insertion direction of said device;

an axially immovable rotatable adjustment screw;

a slide that is in adjustable engagement with said adjustment screw; and a spring-loaded peg slidably mounted in said slide so as to be moveable substantially transversely to said insertion direction for releasable engagement with a hole in said second hinge flap;

wherein said slide and said spring-loaded peg are adapted to move together substantially parallel to said insertion direction when said adjustment screw is rotated, thereby allowing adjustment of an insertion depth of said second hinge flap into said insertion pocket.

18. The device of claim 17, wherein:

said insertion direction is substantially parallel to a surface of the door leaf.

19. The device of claim 17, wherein:

an opening is provided in said device to allow access of a tool to move said spring-loaded peg relative to said slide for bringing said spring-loaded peg out of engagement with said second hinge flap.

20. The device of claim 19, wherein:

said spring-loaded peg comprises a flange portion for engagement with a part of said tool.

21. The device of claim 17, wherein:

an opening is provided in said device for enabling rotation of said adjustment screw by a tool.

22. The device of claim 17, wherein:

a forward edge of said second hinge flap is chamfered on a side thereof which faces said slide; and said hole is chamfered on a side thereof facing away from said slide.

23. The device of claim 22, wherein:

said chamfered side of said forward edge is adapted to depress said spring-loaded peg from an initial position when said second hinge flap is inserted into said insertion pocket;

said spring-loaded peg being restored to said initial position for engaging said second hinge flap when said hole is moved into alignment with said spring-loaded peg.

24. The device of claim 23, wherein:

said chamfered side of said hole is adapted to engage said spring-loaded peg when said spring-loaded peg is restored to said initial position.

25. The device of claim 22, wherein:

a top portion of said spring-loaded peg which is adapted to engage said second hinge flap at said hole is approximately dovetail-shaped in cross-section.

26. The device of claim 17, wherein:

a top portion of said spring-loaded peg which is adapted to engage said second hinge flap at said hole is approximately dovetail-shaped in cross-section.

27. The device of claim 17, wherein:

said spring-loaded peg has a non-circular cross-section.

28. The device of claim 17, wherein said insertion pocket has a dimension which is greater than a dimension of said second hinge flap in a direction which is substantially parallel to a longitudinal axis of said hinge pivot pin, said second hinge flap extending in said direction between first and second edges thereof, further comprising:

adjustment means for adjusting a relative position of said device relative to said second hinge flap in said direction.

29. The device of claim 28, wherein:

said adjustment means comprises two adjustment screws having respective conical tip portions which are adapted to adjustably bear against said first and second edges of said second hinge flap.

30. The device of claim 17, wherein:

said hole in said second hinge flap has a greater dimension in said insertion direction than in a direction which is substantially parallel to a longitudinal axis of said hinge pivot pin.

31. The device of claim 17, wherein:

said spring-loaded peg has at least one flat portion extending parallel to a direction which is substantially parallel to a longitudinal axis of said hinge pivot pin;

said slide comprises a receiving hole for receiving said spring-loaded peg;

said receiving hole has a flat portion corresponding to said flat portion of said spring-loaded peg; and said flat portion of said receiving hole has a greater dimension in said direction than a dimension of said flat portion of said spring-loaded peg to allow said spring-loaded peg to be adjustably positioned relative to said receiving hole in said direction.

32. The device of claim 31, wherein:

said flat portion of said spring-loaded peg and said flat portion of said receiving hole prevent rotation of said spring-loaded peg with respect to said receiving hole.

* * * * *